US010082337B2

(12) United States Patent
Griffin et al.

(10) Patent No.: US 10,082,337 B2
(45) Date of Patent: Sep. 25, 2018

(54) SHELL-AND-TUBE HEAT EXCHANGER WITH SEAL FOR ISOLATING SHELL FROM TUBE FLUID

(71) Applicant: ALFA LAVAL CORPORATE AB, Lund (SE)

(72) Inventors: Ritchie Griffin, Bradenton, FL (US); Andrei Troubeev, Sarasota, FL (US)

(73) Assignee: ALFA LAVAL CORPORATE AB, Lund (SE)

( * ) Notice: Subject to any disclaimer, the term of this patent is extended or adjusted under 35 U.S.C. 154(b) by 122 days.

(21) Appl. No.: 14/941,982

(22) Filed: Nov. 16, 2015

(65) Prior Publication Data

US 2017/0138671 A1 May 18, 2017

(51) Int. Cl.
*F28D 7/16* (2006.01)

(52) U.S. Cl.
CPC ..... *F28D 7/1638* (2013.01)

(58) Field of Classification Search
CPC .... F28D 7/1638; F28D 7/0008; F28F 9/0219; F28F 9/0224; F28F 9/0226; F28F 9/005
USPC ..... 165/158
See application file for complete search history.

(56) References Cited

U.S. PATENT DOCUMENTS 3,948,315 A * 4/1976 Powell ..... F28D 7/06 165/143
4,190,101 A * 2/1980 Hartmann ..... F28F 9/0241 156/296
4,215,744 A * 8/1980 Bowles ..... F28F 9/0219 165/158
4,520,868 A * 6/1985 Grawey ..... F28F 9/0219 165/158
4,848,448 A * 7/1989 Kaarre ..... F28F 9/0219 165/158
5,004,042 A * 4/1991 McMorries, IV ..... F01P 3/207 123/41.01
6,206,086 B1 3/2001 McKey
7,854,254 B2 * 12/2010 Howard ..... F28D 7/06 165/158
2009/0008074 A1 * 1/2009 Vamvakitis ..... F28D 7/0083 165/177

FOREIGN PATENT DOCUMENTS

CN 103557738 A 2/2014
GB 2 000 267 A 1/1979
JP 55-162599 A 12/1980
WO WO 84/03555 A1 9/1984

* cited by examiner

*Primary Examiner* — Tho V Duong
(74) *Attorney, Agent, or Firm* — Buchanan Ingersoll & Rooney PC

(57) ABSTRACT

A shell-and-tube heat exchanger includes a shell which defines a passageway extending from a first end to a second end of the shell, a resilient tubesheet having an outer peripheral surface in sealing engagement with an inner peripheral surface of said shell proximate the first end of the shell, the resilient tubesheet supporting a plurality of tubes which extend within the passageway toward the second end, a cap which closes the first end of the shell in a manner in which a space exists between the cap and the resilient tubesheet, and a seal which seals a portion of the inner peripheral surface of the shell between the resilient tubesheet and the first end from the space between the cap and the resilient tubesheet.

6 Claims, 7 Drawing Sheets

SHELL-AND-TUBE HEAT EXCHANGER WITH SEAL FOR ISOLATING SHELL FROM TUBE FLUID

TECHNICAL FIELD

The present invention relates to a shell-and-tube heat exchanger with a seal for isolating the shell from the tube fluid.

BACKGROUND DISCUSSION

In various shell-and-tube heat exchanger implementations, a material such as an aluminum alloy can be optimal as the material of the shell from a cost and material property standpoint. However, in some applications, the aluminum alloy of the shell would be susceptible to corrosion from contact with the tube fluid. Furthermore, employing a corrosion resistant liner along the entirety of the inner peripheral surface of the shell can be disadvantageous from a cost standpoint. Thus, in applications in which such a liner is not otherwise needed, a need exists for an effective, cost efficient way to seal the shell from the tube fluid.

SUMMARY

A shell-and-tube heat exchanger includes a shell which defines a passageway extending from a first end to a second end of the shell, a resilient tubesheet having an outer peripheral surface in sealing engagement with an inner peripheral surface of said shell proximate the first end of the shell, the resilient tubesheet supporting a plurality of tubes which extend within the passageway toward the second end, a cap which closes the first end of the shell in a manner in which a space exists between the cap and the resilient tubesheet, and a seal which seals a portion of the inner peripheral surface of the shell between the resilient tubesheet and the first end from the space between the cap and the resilient tubesheet.

In an embodiment, the seal is in contact with the portion of the inner peripheral surface of the shell between the resilient tubesheet and the first end.

In an embodiment, the seal comprises a resilient element compressed between the resilient tubesheet and the cap.

In an embodiment, the resilient element has an elongated cross-sectional shape.

In an embodiment, the resilient element is in contact with a surface of the cap that slopes down toward the resilient tubesheet.

In an embodiment, the seal comprises a liner in contact with an outer peripheral surface of the resilient tubesheet and an outer peripheral surface of the cap.

In an embodiment, the liner extends from the first end of the shell to a middle portion of the resilient tubesheet.

In an embodiment, the liner has a bent shape and is in contact with an end face of the shell.

In an embodiment, an O-ring is disposed between the cap and the liner to seal the space from an exterior of the shell-and-tube heat exchanger.

In an embodiment, an O-ring is disposed between the cap and the tube to seal the space from an exterior of the shell-and tube heat exchanger.

DETAILED DESCRIPTION

Figure 1A:
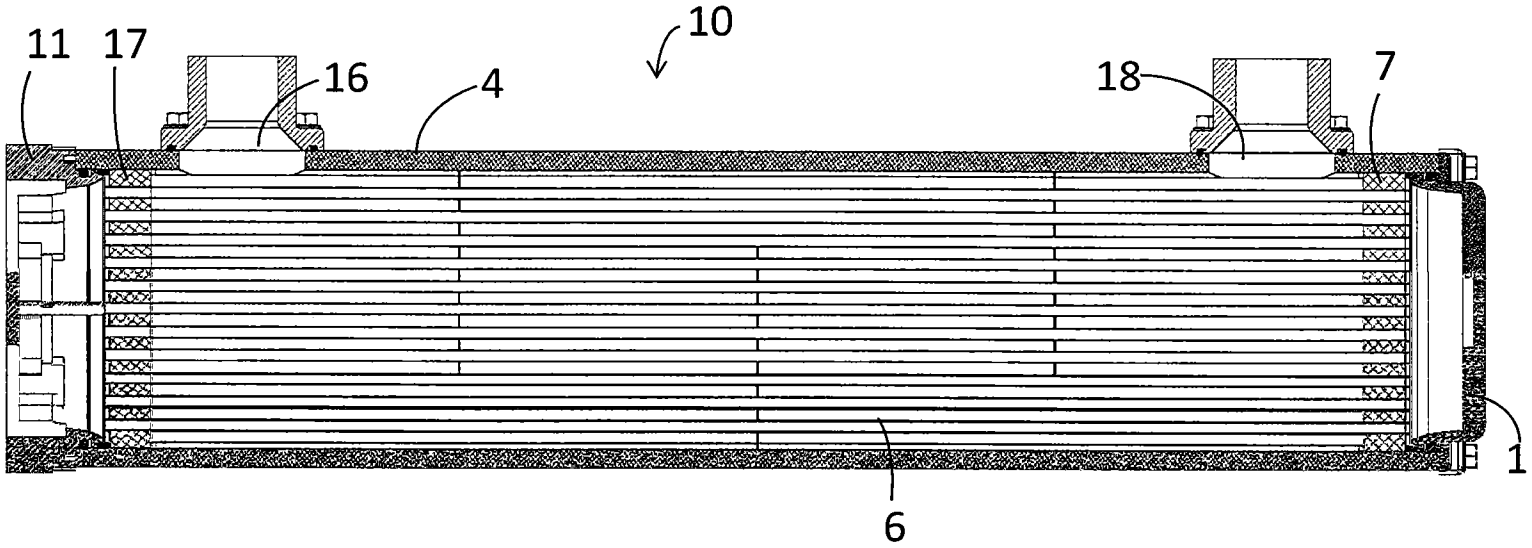
FIG. 1A is a cross-sectional view illustrating a shell-and-tube heat exchanger according to a first embodiment.

Hereinafter, embodiments of a shell-and-tube heat exchanger will be described with reference to the above-listed figures. The same reference numerals are given to common members in each drawing.

As illustrated in the FIG. 1A, a shell 4 of a shell-and-tube heat exchanger 10 defines a passageway extending from a first end (the left end in the figure) to a second end (the right end in the figure) of the shell 4. The depicted configuration is of a straight-tube one-pass type in which one end of the heat exchanger constitutes an inlet plenum for the tube fluid while the other end constitutes an outlet plenum for the tube fluid. In such an embodiment, the tube-side fluid is introduced via one or more inlets in a first cap 1 which closes the first end of the shell 4, and removed via one or more outlets in a second cap 11 which closes a second end of the shell, while the shell-side fluid is introduced via at least one inlet 16 in the shell 4 and removed via at least one outlet 18 in the shell 4. However, the seal configuration of the first embodiment can also be used in, for example, a straight-tube two-pass type or a U-tube type shell-and-tube heat exchanger.

Figure 1C:
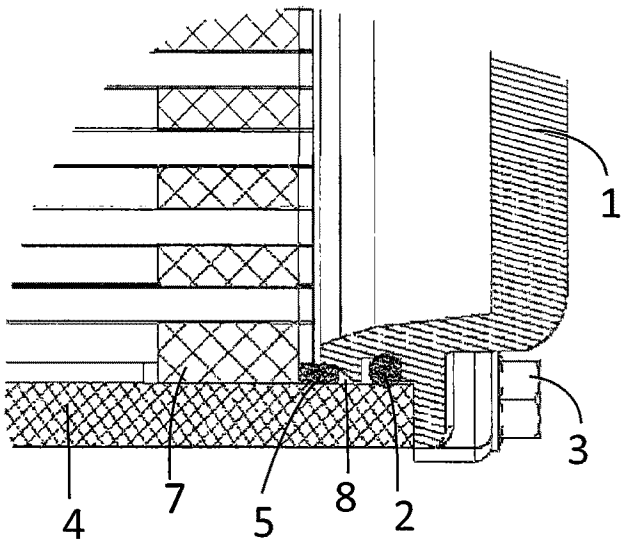
FIG. 1C is a cross-sectional view illustrating a detail of the first end of the shell-and-tube heat exchanger according to the first embodiment.
Figure 1B:
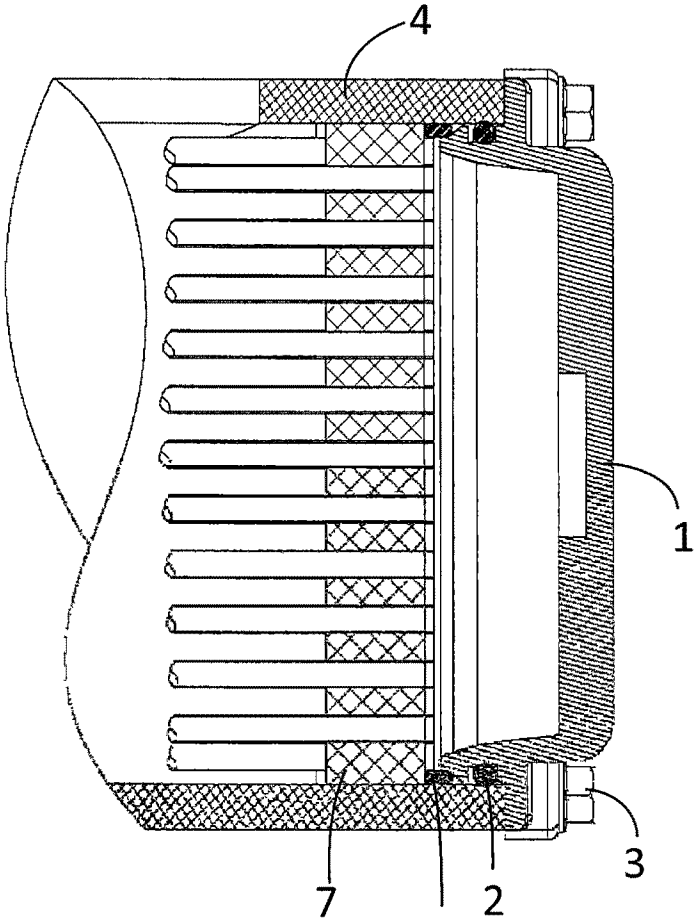
FIG. 1B is a cross-sectional view illustrating a first end of the shell-and-tube heat exchanger according to the first embodiment.

As illustrated in FIG. 1B, a tubesheet 7 is installed proximate the first end of the shell 4, and a cap (first cap 1) closes the first end of the shell 4 in a manner in which a space exists between the cap 1 and the tubesheet 7. Furthermore, in the embodiment, a second tubesheet 17 is installed proximate the second end of the shell 4, and the second cap 11 closes the second end of the shell 4 in a manner in which a space exists between the second cap 11 and the second tubesheet 17. However, in other shell-and-tube heat exchanger configurations using the disclosed seal arrangement, such as a U-tube type, a second tubesheet 7 is not needed.

The tubesheet 7 is made of resilient material such as rubber and is provided to have an outer peripheral surface in sealing engagement with an inner peripheral surface of the shell 4. The tubesheet 7 therefore acts as a seal to isolate the shell-side fluid from the tube-side fluid. The tubesheet 7 supports a plurality of tubes 6 which extend within the passageway toward the second end. The tube-side fluid which is introduced via a cap inlet flows through the tubes in the passageway such that thermal exchange occurs between the tube-side fluid and the shell-side fluid which is introduced directly into the passageway.

As illustrated in FIG. 1C, a resilient element 5 which is compressed between the tubesheet 7 and the cap 1 is in contact with the portion of the inner peripheral surface of the shell 4 between the tubesheet 7 and the first end. The resilient element 5 seals the portion of the inner peripheral surface of the shell 4 between the tubesheet 7 and the first end from the space between the cap 1 and the tubesheet 7. In this way, the tube-side fluid is prevented from contacting the shell 4. By providing for such a seal, the shell can be made from a material that would otherwise be corroded from extended contact with the tube-side fluid. For example, the tube can be made from unlined aluminum, plastic, or magnesium even when the tube-side fluid is, for example, sea water, pool water, contaminated engine coolant, or any other potentially corrosive fluid. Of course, the present seal could be used with any combination of fluid and shell material in which the fluid could corrode the shell material.

Figure 2B:
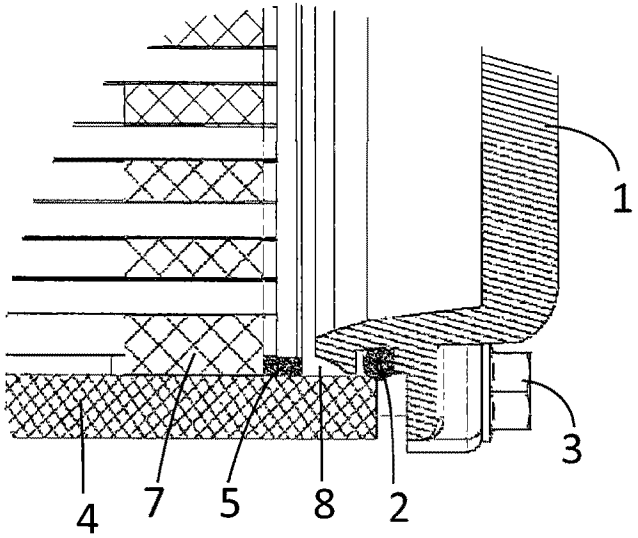
FIG. 2B is a cross-sectional view illustrating a detail of the first end of the shell-and-tube heat exchanger according to the first embodiment with the cap uninstalled.
Figure 2A:
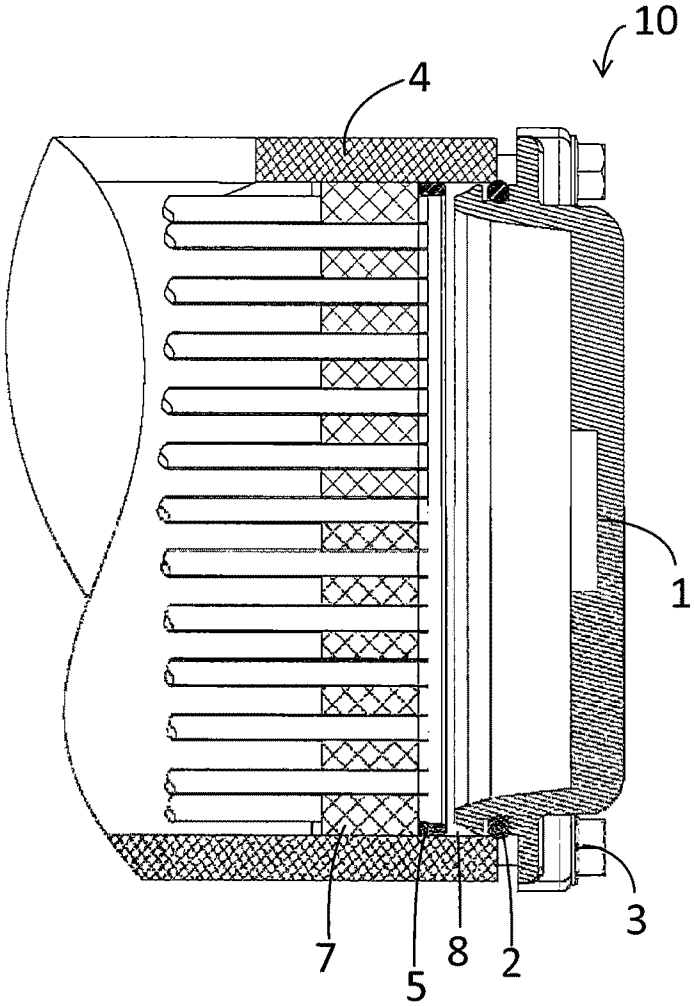
FIG. 2A is a cross-sectional view illustrating a first end of the shell-and-tube heat exchanger according to the first embodiment with the cap uninstalled.

FIGS. 2A and 2B illustrate the resilient element 5 in place but prior to the cap 1 being fully installed. The resilient element 5 has an elongated cross-sectional shape and, once the cap is installed is in contact with a surface 8 of the cap that slopes down toward the resilient tubesheet. The elongated shape of the resilient element 5 and the slope of the cap surface 8 in contact with the resilient element 5 can help insure that the resilient element 5 provides sufficient sealing pressure against the tubesheet 7 and the inner peripheral surface of the shell 4.

Furthermore, an O-ring 2 is disposed between the cap 1 and the shell 4 to further seal the tube-side fluid space from an exterior of the shell-and tube heat exchanger 10. In the embodiment, the O-ring 2 is disposed in a cavity in the cap 1 and bears against the inner peripheral surface of the shell 4, and the cap 1 is bolted to an end face of the shell 4 via threaded bolts 3 which extend through axially-aligned holes provided in the cap 1 and the shell 4. Of course, the cap 1 can be fixed in place by other methods in modified configurations, such as, for example, by snap-fitting.

Figure 3A:
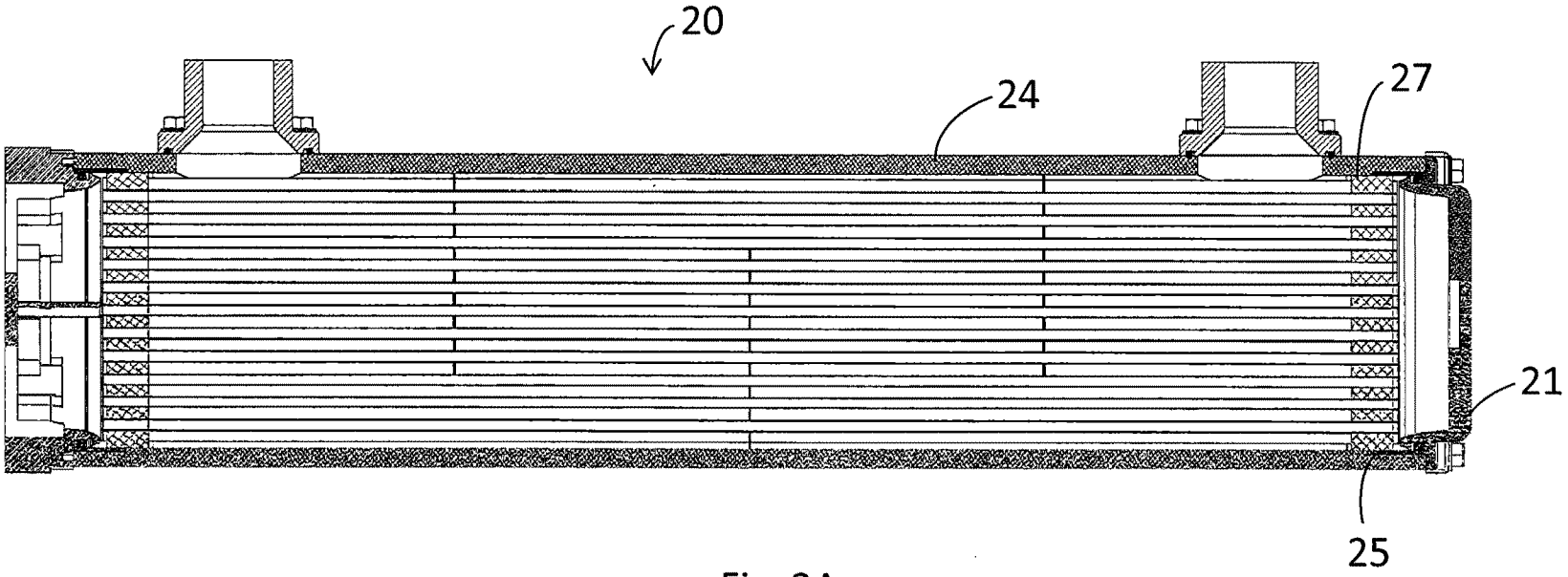
FIG. 3A is a cross-sectional view illustrating a shell-and-tube heat exchanger according to a second embodiment.
Figure 3C:
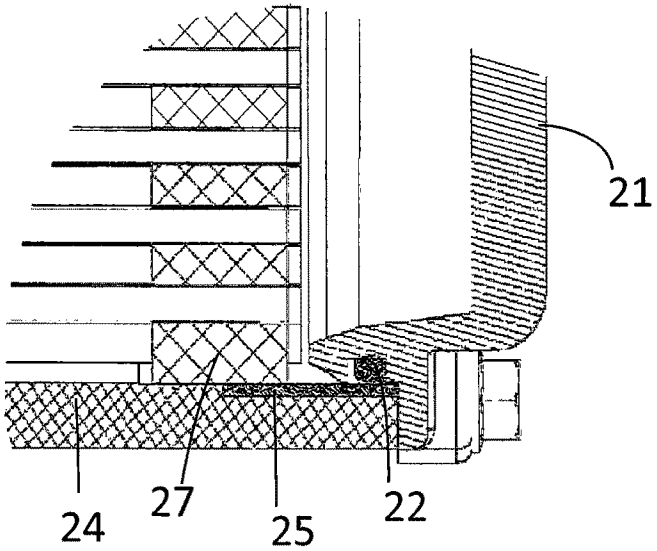
FIG. 3C is a cross-sectional view illustrating a detail of the first end of the shell-and-tube heat exchanger according to the second embodiment.
Figure 3B:
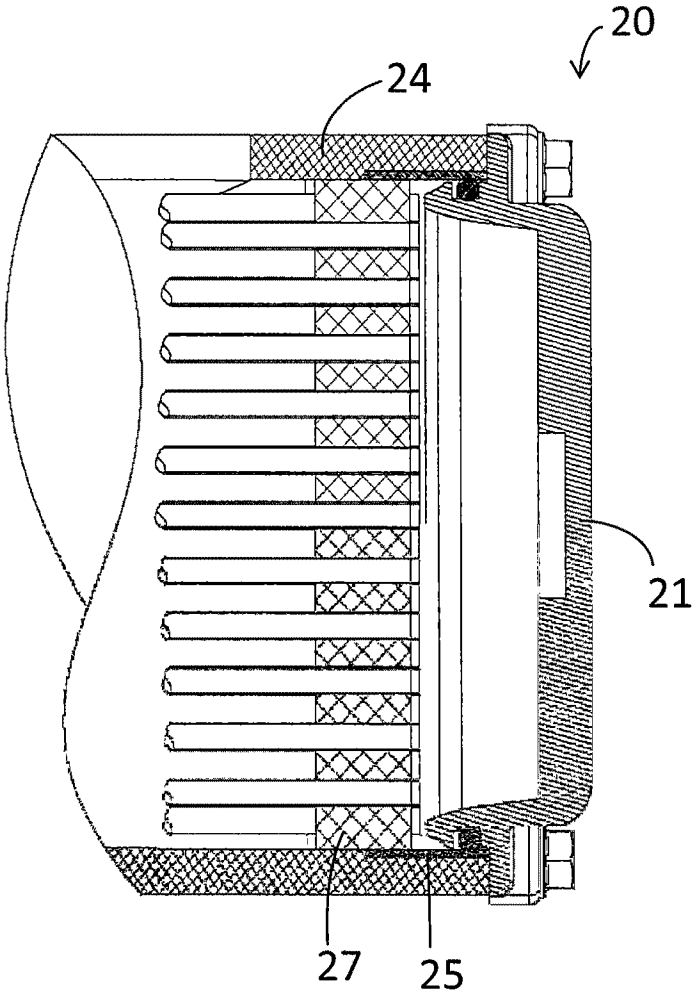
FIG. 3B is a cross-sectional view illustrating a first end of a shell-and-tube heat exchanger according to the second embodiment.

FIGS. 3A, 3B and 3C illustrate a shell-and-tube heat exchanger 20 according to a second embodiment. The second embodiment differs from the first embodiment in the structure of the shell 24 and the seal. In the embodiment, the seal is a liner 25 in contact with both an outer peripheral surface of the tubesheet 27 and an outer peripheral surface of the cap 21. The liner 25 is made from a corrosion-resistant material such as brass, aluminum bronze, or titanium.

In the embodiment, the liner 25 fits within a groove in the inner peripheral surface of the shell 24 that extends from the first end of the shell 24 to a middle portion of the tubesheet 27. The depth of the groove is made the same as the thickness of the liner 25 so that a substantially uninterrupted inner peripheral surface is formed by the shell 24 and the liner 25. As illustrated in FIGS. 3A, 3B, and 3C, the interface between the liner 25 and the shell 24 is provided at the middle portion of the tubesheet 27. With this configuration, the tubesheet 27 seals the interface between the liner 25 and the shell 24. Furthermore, in the embodiment, the O-ring 22, instead of bearing against the inner peripheral surface of the shell 24 as in the first embodiment, bears against the inner peripheral surface of the liner 25.

Figure 4B:
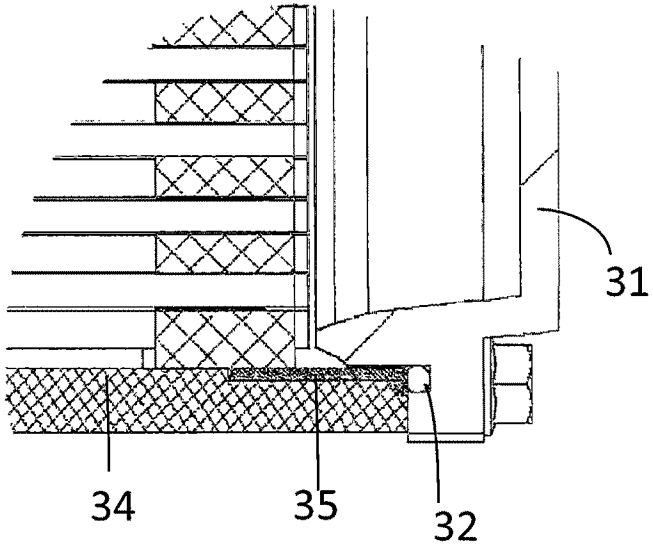
FIG. 4B is a cross-sectional view illustrating a detail of the first end of the shell-and-tube heat exchanger according to the third embodiment.
Figure 4A:
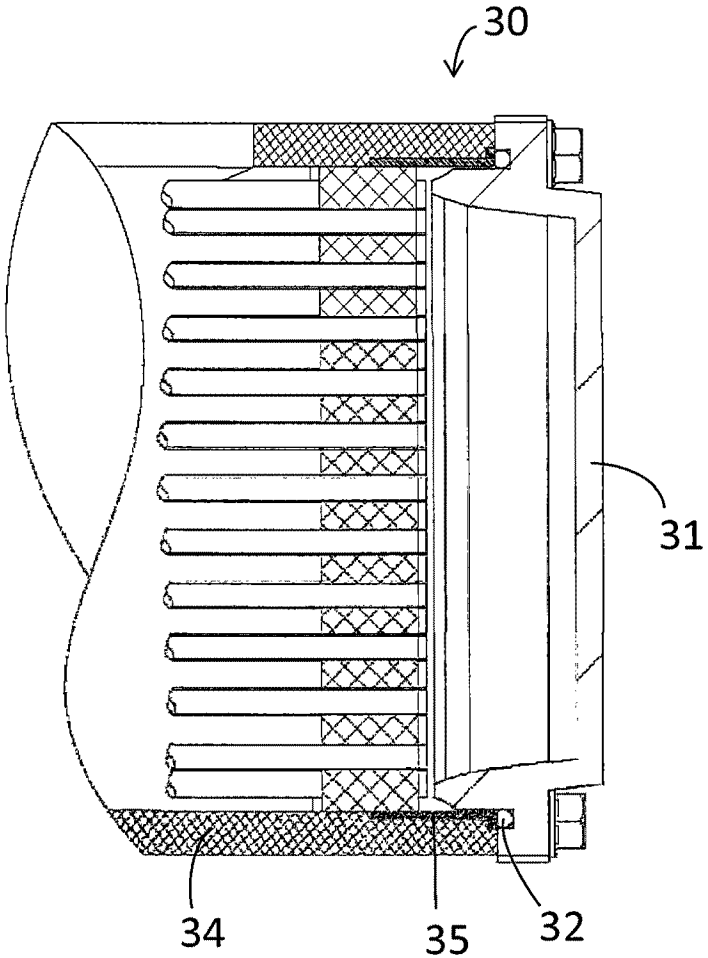
FIG. 4A is a cross-sectional view illustrating a first end of a shell-and-tube heat exchanger according to a third embodiment.

FIGS. 4A and 4B illustrate a shell-and-tube heat exchanger 30 according to a third embodiment. The third embodiment differs from the first and second embodiments in the structure of the cap 31, the O-ring 32, the shell 34, and the seal. The seal of the third embodiment is a liner 35 which has a bent shape and is in contact with an end face of the shell 34 as well as the inner peripheral surface of the shell 34. Furthermore, the shell 34 has a groove in its end face as well as its inner peripheral surface for receiving the bent liner 35.

Furthermore, in the third embodiment, the O-ring 32 is disposed between the cap 31 and the portion of the bent liner 35 which is parallel to the end face of the shell 34 to seal the space from the exterior of the heat exchanger 30. The cavity in the cap 31 which receives the O-ring therefore faces the axial direction in the third embodiment, rather than in the radial direction as in the first and second embodiments.

Figure 5:
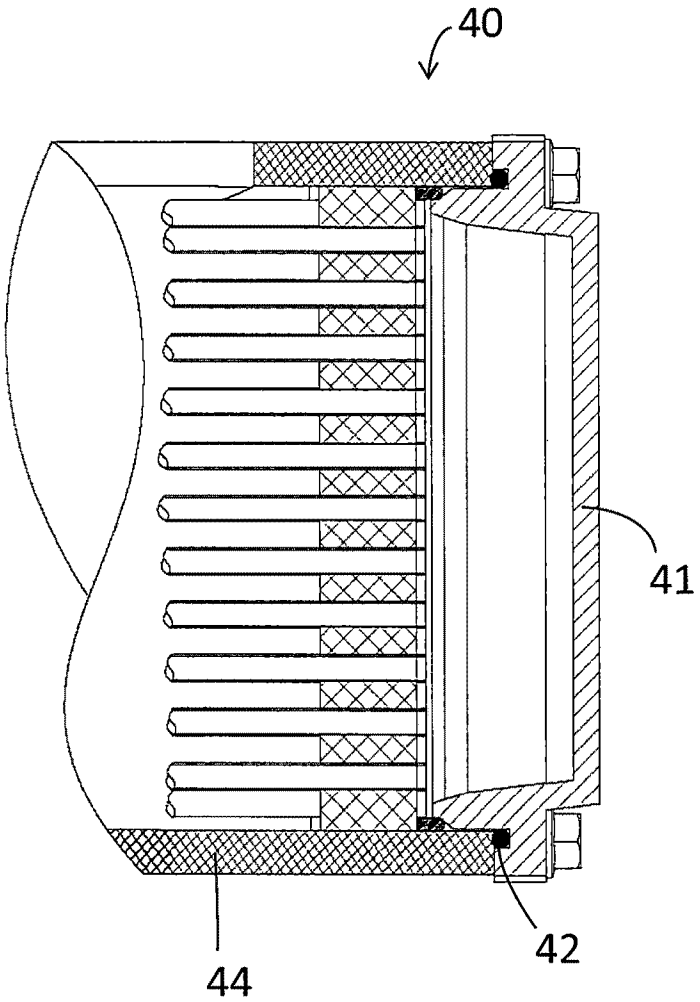
FIG. 5 is a cross-sectional view illustrating a first end of a shell-and-tube heat exchanger according to a fourth embodiment.

FIG. 5 illustrates a fourth embodiment of a shell-and-tube heat exchanger 40 which is a resilient element 45 arranged in the same manner as the first embodiment, and in which the O-ring 42 is disposed between the cap 41 and the end face of the shell 44 to seal the space from the exterior of the heat exchanger 40. Furthermore, the cavity in the cap 41 which receives the O-ring 42 faces the axial direction.

The detailed description above describes a shell-and-tube heat exchanger. The invention is not limited, however, to the precise embodiments and variations described. Various changes, modifications and equivalents can be effected by one skilled in the art without departing from the spirit and scope of the invention as defined in the accompanying claims. It is expressly intended that all such changes, modifications and equivalents which fall within the scope of the claims are embraced by the claims.

What is claimed is:

1. A shell-and-tube heat exchanger comprising:

a shell which defines a passageway extending from a first end to a second end of the shell;

a resilient tubesheet having an outer peripheral surface in sealing engagement with an inner peripheral surface of the shell proximate the first end of the shell, said resilient tubesheet supporting a plurality of tubes which extend within the passageway toward the second end;

a cap which closes the first end of the shell in a manner in which a space exists between the cap and the resilient tubesheet; and a seal which seals a portion of the inner peripheral surface of the shell between the resilient tubesheet and the first end from the space between the cap and the resilient tubesheet, wherein the seal is in contact with a surface of the cap that slopes down toward the resilient tubesheet such that a gap between a surface of the cap and the shell is wider closer to the resilient tubesheet, and wherein the seal comprises a resilient element compressed between the resilient tubesheet and the cap.

2. The shell-and-tube heat exchanger of claim 1, wherein the seal is in contact with the portion of the inner peripheral surface of the shell between the resilient tubesheet and the first end.

3. The shell-and-tube heat exchanger of claim 1, wherein the resilient element has an elongated cross-sectional shape.

4. The shell-and-tube heat exchanger of claim 1, further comprising an O-ring disposed between the cap and the shell to seal the space from an exterior of the shell-and tube heat exchanger.

5. A shell-and-tube heat exchanger comprising:

a shell which defines a passageway extending from a first end to a second end of the shell;

a resilient tubesheet having an outer peripheral surface in sealing engagement with an inner peripheral surface of the shell proximate the first end of the shell, said resilient tubesheet supporting a plurality of tubes which extend within the passageway toward the second end;

a cap which closes the first end of the shell in a manner in which a space exists between the cap and the resilient tubesheet;

a first seal which seals a portion of the inner peripheral surface of the shell between the resilient tubesheet and the first end from the space between the cap and the resilient tubesheet; and a second seal disposed between the cap and the shell to seal the space from an exterior of the shell-and tube heat exchanger, wherein the second seal is a piece separate from the first seal and is spaced apart from the first seal.

6. A shell-and-tube heat exchanger comprising:

a shell which defines a passageway extending from a first end to a second end of the shell;

a resilient tubesheet having an outer peripheral surface in sealing engagement with an inner peripheral surface of the shell proximate the first end of the shell, said resilient tubesheet supporting a plurality of tubes which extend within the passageway toward the second end;

a cap which closes the first end of the shell in a manner in which a space exists between the cap and the resilient tubesheet;

a seal which seals a portion of the inner peripheral surface of the shell between the resilient tubesheet and the first end from the space between the cap and the resilient tubesheet; and an O-ring disposed between the cap and the shell to seal the space from an exterior of the shell-and tube heat exchanger, wherein the seal is in contact with a surface of the cap that slopes down toward the resilient tubesheet such that a gap between a surface of the cap and the shell is wider closer to the resilient tubesheet.

* * * * *